US005345962A

United States Patent [19]

Moss

[11] Patent Number: 5,345,962

[45] Date of Patent: Sep. 13, 1994

[54] ARCH SUPPORTED FABRIC STRUCTURE

[76] Inventor: C. William Moss, 7830 E. Pecos La., Scottsdale, Ariz. 85253

[21] Appl. No.: 919,734

[22] Filed: Jul. 27, 1992

[51] Int. Cl.[5] ..... E04H 15/36

[52] U.S. Cl. ..... 135/102; 135/105; 135/116; 403/43; 403/42

[58] Field of Search ..... 135/102, 104, 105, 106, 135/116, 906, 908; 403/43, 48, 42, 13, 109

[56] References Cited

U.S. PATENT DOCUMENTS

| | | | |
|---|---|---|---|
| 3,376,879 | 4/1968 | Huddle | 135/106 X |
| 3,388,711 | 6/1968 | Huddle . | |
| 3,640,296 | 2/1972 | Huddle . | |
| 3,811,454 | 5/1974 | Huddle . | |
| 3,856,029 | 12/1974 | Huddle . | |
| 3,886,961 | 6/1975 | Geiger et al. . | |
| 3,894,766 | 7/1975 | Woodward | 135/106 X |
| 3,909,993 | 10/1975 | Huddle . | |
| 4,064,663 | 12/1977 | Moss . | |
| 4,092,992 | 6/1978 | Huddle . | |
| 4,269,210 | 5/1981 | Marks | 135/104 |
| 4,555,124 | 11/1985 | Millington | 403/43 X |
| 4,584,800 | 4/1986 | Burt et al. . | |
| 4,614,451 | 9/1986 | Braisted, Jr. | 403/43 |
| 4,745,936 | 5/1988 | Scherer | 135/104 |
| 4,886,084 | 12/1989 | Lawrence et al. . | |
| 5,215,109 | 6/1993 | Kent, Jr. | 135/105 X |

FOREIGN PATENT DOCUMENTS

| | | | |
|---|---|---|---|
| 1373418 | 8/1964 | France | 135/106 |

*Primary Examiner*—Carl D. Friedman
*Assistant Examiner*—Lan C. Mai
*Attorney, Agent, or Firm*—Marshall & Melhorn

[57] ABSTRACT

A lightweight fabric structure having a plurality of arches, and more particularly, a pavilion type tent structure having arches to define the periphery of the structure with a flexible fabric membrane in tension between the arches. Adjustable length tension bars are placed between adjacent arches to maintain tension and hold the arches upright. Adjacent segments of the membrane are sewn back-to-back to provide a reverse curve seam to increase the usable space inside the fabric structure without the use of a center support or tension lines.

14 Claims, 4 Drawing Sheets

ARCH SUPPORTED FABRIC STRUCTURE

BACKGROUND OF THE INVENTION

1. Field of the Invention

The invention relates generally to a lightweight tension structure having a plurality of arches, and in particular, to a pavilion type tent structure having crossbars and flexible fabric membranes in tension between peripheral arches such that the tension may be maintained and the arches kept upright without additional support members or tension guide lines.

2. Summary of the Related Art

Fabric structures and enclosures are used in a variety of applications. Large fabric domes cover outdoor arenas, shopping malls, swimming pools, tennis courts and other locations having a need for a customized shelter. Specially designed fabric structures may be temporarily or permanently used for fairs, meeting halls, pavilions, barracks, and other similar applications. Smaller tents provide camping and residential shelters.

There is also an increasing demand throughout the world for residential dwellings that provide housing at a low cost. Numerous problems are encountered in providing adequate housing. These problems include, but are not limited to, the cost of the structure, the transportation and availability of materials, and the skilled labor requirements. The need exists for a fabric dwelling that is cost effective and convenient to build.

Fabric structures are also used extensively for commercial awnings and canopies to provide both shelter and promotional benefits to a business entity. In addition to the more traditional uses noted above, fabric structures may also be used for sculptures and other more artistic purposes.

In fabric structures, the proper tension must be maintained on the fabric to accommodate the intended application of such fabric structure. A number of different support structures and tensioning means have been developed to maintain the desired tension in a fabric structure. Most of the smaller or mid-sized fabric structures utilize a center support means with anchored guide lines attached to side supports in order to maintain the structure.

In many fabric structures, it is desirable to reduce or eliminate the center support means and guide lines needed to maintain a fabric at the proper tension and to minimize the overall support frame. Special ventilation systems to support the fabric are often required in such situations. In other cases, a complex frame is needed to support the fabric structure.

In U.S. Pat. No. 3,886,961 to Geiger et al, a portable structure utilizes the cooperation of flexible arches as compression members in the structure. The tensioned membrane is provided with stressed cables to brace the arches and form a rigid structure.

U.S. Pat. Nos. 3,909,993 and 4,092,992 to Huddle show additional structures using arched supports and means for making laminated arch members. The supports are forced apart in the crown area of the arch by the use of inclined arches or other tensioning means to support the structure.

A building structure including one polyhyparic surface formed of a continuous tensioned web coupled to structural members along its periphery is disclosed in U.S. Pat. No. 4,584,800 to Burt et al.

U.S. Pat. No. 4,886,084 to Lawrence et al. shows a panelized fabric-covered structure with removable and replaceable fabric panels, including an expandable frame having a plurality of frame members for holding a fabric panel.

SUMMARY OF THE INVENTION

The present invention relates to a portable structure provided with peripheral arches and a fabric membrane to provide low cost shelter that is convenient to set up, tear down, and transport. Because no center supports or tension lines are needed, the structure of the present invention provides efficient space utilization.

In accordance with the present invention, there is provided a lightweight fabric structure having a plurality of arches, and more particularly, to a pavilion type tent structure having arches to define the periphery of the structure with a flexible fabric membrane in tension between the arches. Tension spreader bars are placed between adjacent arches to maintain tension and hold the arches upright.

The arches are assembled from three components, two curved sections and a short, angled connecter to join the two sections at the top of the arch. A common base plate is used to support adjacent arches. The arches may be extended once mounted in the base plate to tighten the fabric membrane. The flexible fabric membrane is formed from individual pieces of fabric fitted for each of the arches. The flexible fabric extends for nearly the complete length of the arch, except for small cutaways at the angled connector and at the spreader bars. The pieces of the flexible fabric are sewn back to back for a reverse curve pattern on the outwardly extending arches, which increases the internal space of the fabric structure.

The downward force of the flexible fabric membrane causes the arches to curve inward. The arches are also provide with rotatable extenders at the feet of the arches to extend the arches upward to tighten the membrane. Spreader bars are positioned and extended between adjacent arches above the base plate to maintain the position of the arches and provide the necessary tension to the flexible fabric membrane. The spreader bars also include a rotatable extender in one end to achieve the desired tension. No guide lines or center support members are needed to maintain the structure.

The preferred embodiment includes four arches. In an alternate embodiment having only two arches, the arches are located on opposite sides of the structure. Since spreader bars are not used in the alternate embodiment to maintain the necessary tension for structural integrity, arches are formed in the flexible fabric membrane and the corners of the arched membrane are directly anchored in the ground to provide the necessary tension for the structure.

An object of the present invention is provide a low cost and easy to assemble shade structure which can be utilized as an outdoor pavilion, pool cover, temporary housing, storage structure, or other similar application. The segmented arches and membrane are designed for easy transport, assembly, and disassembly.

An additional object of the present invention is to provide a fabric structure with no center support means and with no tension guide lines. Such a structure is preferred from a user standpoint because of the increased flexibility and space available when support means and tension guide lines are eliminated. The internal space is also optimized by the use of back to back reverse curve seams.

A further object of the present invention is to provide an improved arch and tension spreader bar support for the fabric structure. The arches and spreader bar supports are capable of creating and maintaining the necessary tension to support the fabric structure. The angled crown of the arch improves the tension transfer capabilities of the arch.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
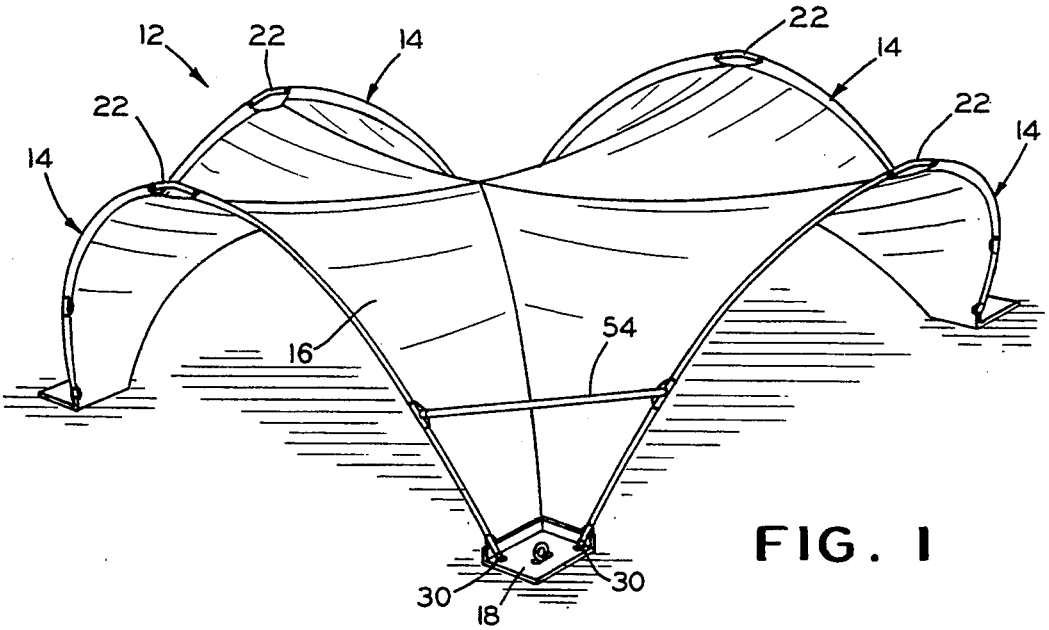
FIG. 1 is a perspective view of a fabric structure according to the present invention comprising four arches.
Figure 2:
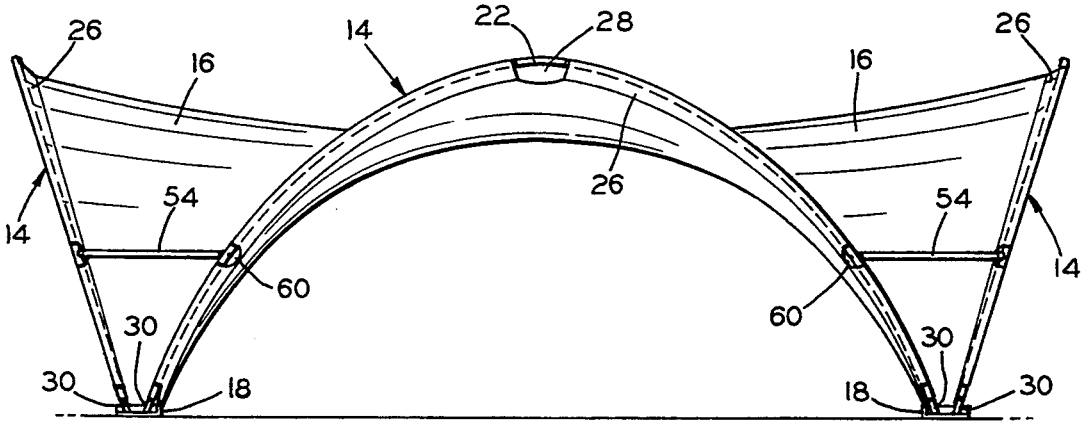
FIG. 2 is a front view of the fabric structure shown in FIG. 1.

Referring now to the drawings, there is shown in FIGS. 1–2 a fabric structure 12 formed by a plurality of arches 14 and a fabric membrane 16 extending between the arches 14.

In the four arch structure shown in FIG. 1, the arches 14 define the periphery of the structure 12. The arches 14 are secured to base plates 18 located at the corners of the structure 12, with adjacent arches 14 using a common base plate 18. Other means for securing the arches 14, such as stakes, may be used instead of the base plates 18.

Access to the interior portion of the structure 12 is permitted through any of the arches 14. The arches 14 may be kept open, without any side covering, for a pavilion type structure. Fabric walls (not shown) may also be affixed to the arches 14 to provide privacy or protection from the environment. The fabric walls may include doors, windows, and other customary dwelling features.

An arch 14 is provided with three segments for convenience in assembling the structure 12 and to improve the tension transfer capabilities of the arch 14. Each arch 14 includes a pair of identical curved poles 20 extending from the corner base plate 18 to the crown 22 of the arch 14. The crown 22 is a solid, tubular element with a center bend 24 at an angle of approximately 140 degrees. The angled crown 22, typically made of steel or aluminum, is designed to withstand the significant forces generated at the apex of the arch 14.

The pole sections 20 may be made out of various tubular materials, such as aluminum. One end 20A of the poles 20 is open such that the crown 22 is partially inserted into the open end 20A when constructing the arch 14. The insertion of the crown 22 into the poles 20 is limited by the center bend 24. Due to the compression forces on the arches 14, an additional locking mechanism is not typically required to secure the crown 22.

Figure 3:
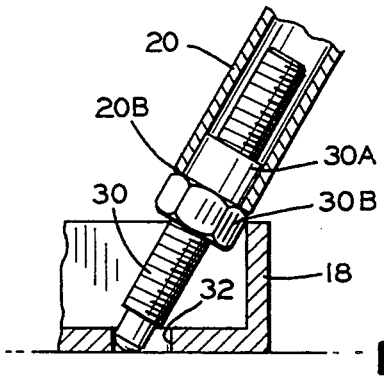
FIG. 3 is a perspective view of the mounting plate for securing the arches of the present invention, including a cut-away segment of the arch section to disclose the extension shaft used to adjust the length of the arch.

An extension shaft 30, as shown in FIG. 3, is attached to the pole 20 on the end 20B opposite the crown 22. An internally thread bore member 30A is rigidly secured in the pole end 20B. The extension shaft 30 is provided with one end threadably connected to the bore member 30A. The other end of the extension shaft is place in aperture 32 on the base plate 18. The extension shaft 30 includes a head 30B for receiving a tool to permit turning of the shaft 30 for extending and retracting the length of the length of the arch 14.

Figure 4:
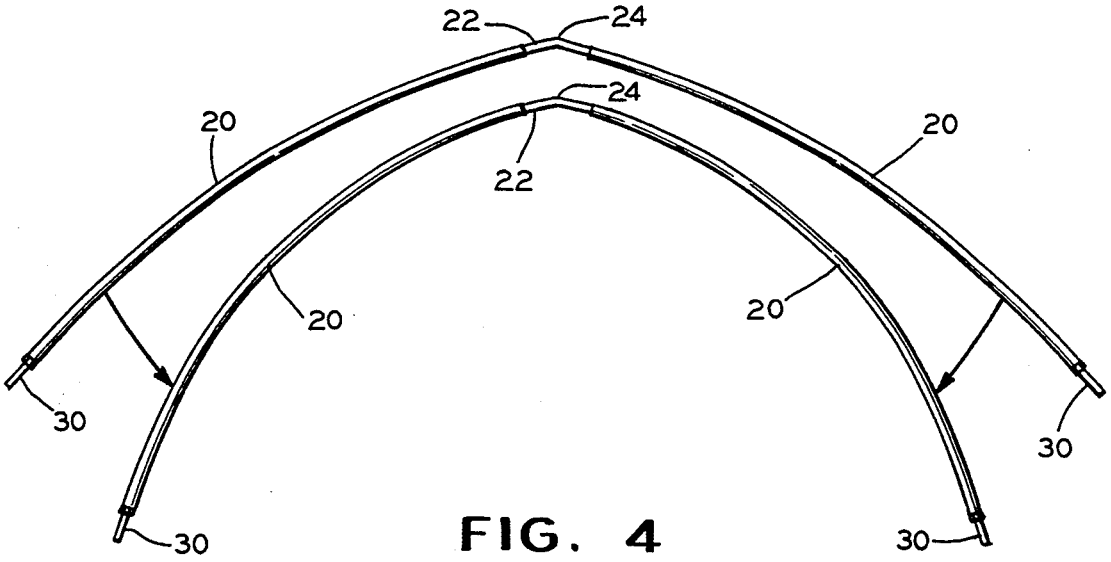
FIG. 4 shows the arch used to support the fabric structure before the arch is mounted in the base plate and after the arch is compressed to fit into the base plate.
Figure 4A:
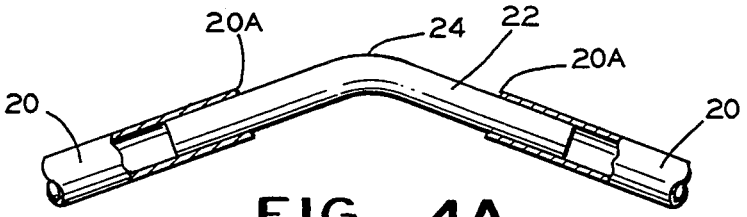
FIG. 4A shows the angled construction for the crown segment of the arch.

FIGS. 4 and 4A disclose a fully assembled arch 14 absent the membrane 16. The crown 22 is a solid, tubular element with a center bend 24 at an angle of approximately 140 degrees. The angled solid crown 22, typically made of steel or aluminum, is designed to withstand the significant forces generated at the apex of the arch 14. FIG. 4 shows the change in shape of an arch from a non-tension state prior to installation and a tensioned state as the ends of the poles 20 are compressed to insert the extension shafts 30 into the mounting plates 18.

Figure 5:
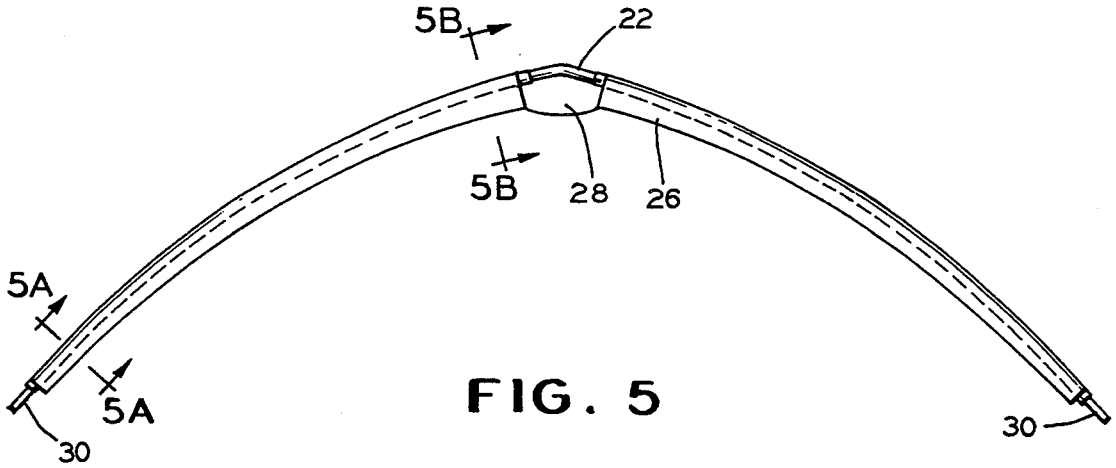
FIG. 5 shows the tapered sleeve for receiving the curved poles of the arch.

By segmenting the arches 14, the individual poles 20 are easily inserted into the sleeves 26 attached to the outer edges of the membrane 16. The sleeves 26 include an open segment 28 such that after the poles 20 have been inserted into the sleeve 26, the crown 22 may be installed in the open ends 20A of the two poles 20 to form the arch 14. The open segment 28 also facilitates the desired tension distribution on the membrane 16 to improve the overall rigidity of the structure 12 as shown in FIG. 5

Figure 5A:
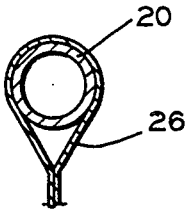
FIGS. 5A and 5B are cross sections of the sleeve shown in FIG. 5 with a pole inserted in the sleeve.
Figure 5B:
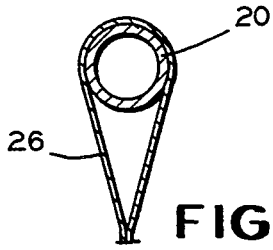

The sleeves 26 are wider near the crown (FIG. 5B) and narrower at the bottom (FIG. 5A) when mounted on the arches 14. The compression of the arch 14 for insertion in the baseplate 18 and the extension of the poles 20 by rotating the extension shaft 30 cause the crown 22 of the arch 14 to extend upward. The wider sleeve 26 permits the arch to achieve a higher position and increase the tension on the membrane 16, which permits the center of the membrane 16 to be raised and maintained at the desired height without internal support poles.

Figure 6:
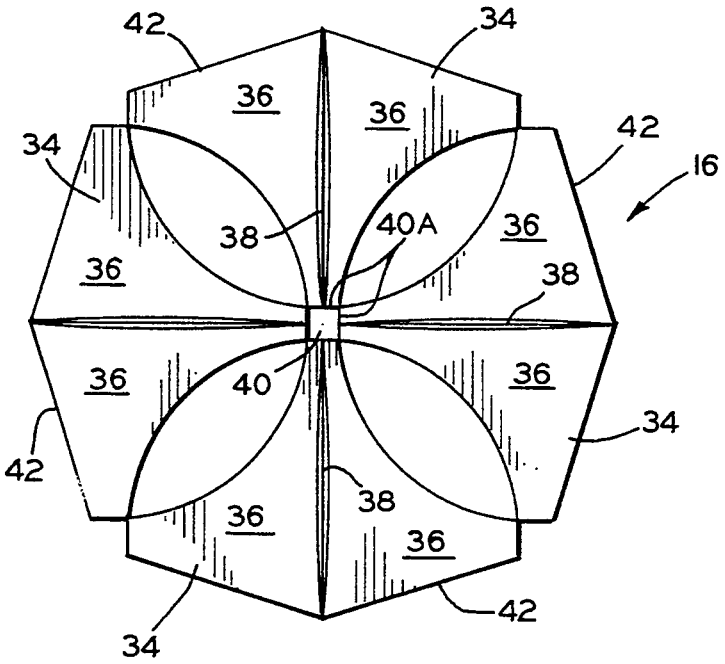
FIG. 6 shows the preferred pattern of the fabric provided for the structure shown in FIG. 1.

The membrane 16 is made from canvas or other suitable fabric. A pattern for forming the membrane 16 is shown in FIG. 6. A fabric segment 34 is provided for each arch 14. The fabric segment 34 includes two mirror-image pieces of material 36 sewn together to form a gore 38 along the upper ridges of the structure 12.

The interior edge 40A of the fabric segment 34 is sewn to a center piece 40 or the center of the structure may be left open. When the crown 22 of the arch 14 is raised in height, the gore 38 facilitates the desired expansion of the fabric segment 34. Instead of comprising a straight line seam, the gore 38 is curved inward such that crown 22 of the arch 14 is the highest point on the structure 12 and that the tension on the fabric segments 34 is sufficient to raise the center piece 40 to an acceptable height. The sleeves 26 for receiving the poles 20 are attached to the exterior edge 42 of the fabric segment 34.

Figure 7:
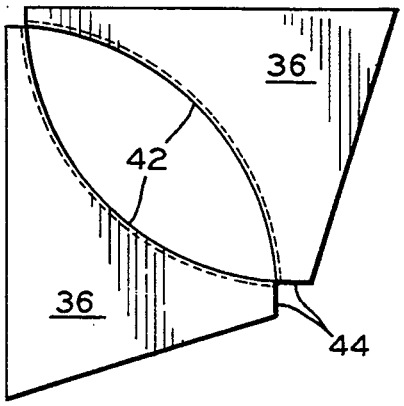
FIG. 7 shows the layout of two fabric segments for sewing the segments to form a gore and a reverse curve when mounted on an arch.
Figure 8:
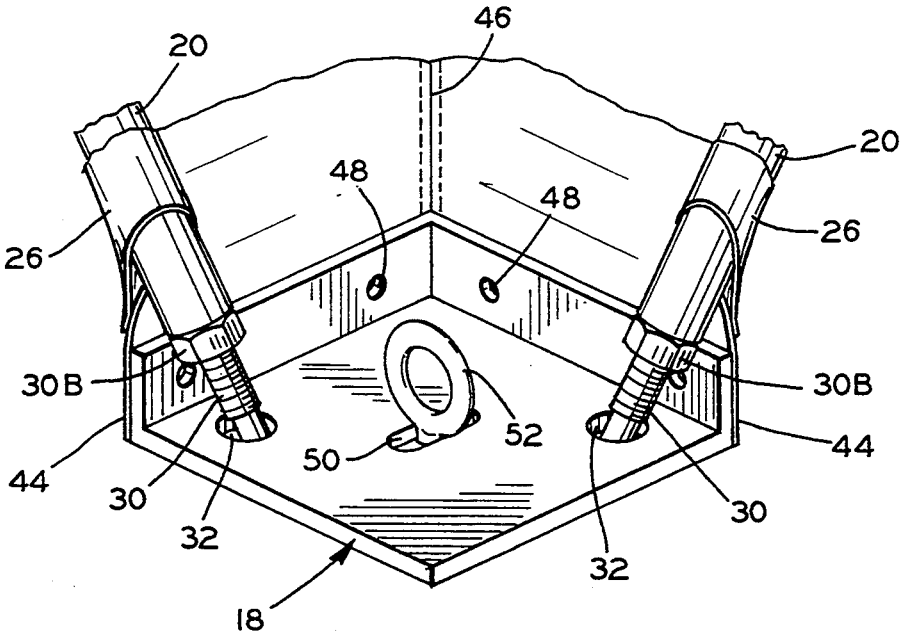
FIG. 8 is a perspective view of the means used to secure the fabric structure, including a base plate and an anchor lug.

The two side edges of each fabric segment 34 are provided with a curved section 42 and a straight section 44. FIGS. 7 and 8 show how the curved sections 42 of adjacent fabric segments 34 are sewn together to form a reverse curve seam 46. By sewing the curved sections 42 back to back, a reverse curve seam 46 is formed when the fabric segments 34 are in tension on the arches 14. When canvas or similar material is in tension, a standard seam will form a straight line structural configuration or curve inward. In contrast, the back to back sewing for the reverse curve seam 46 results in an outward curve along the seam 46. This provides more internal space for the structure 12.

FIG. 8 also shows how the straight sections 44 are attached to the base plates 18. The straight section 44 may be reinforced and provided with a fastening means 48, such as rivets, snaps or mounting bolts, for connection to the base plate 18.

The base plate 18 is provided with two apertures 32 for receiving the extension shaft 30 of the arches 14. The base plate 18 also includes a means for securing the base plate 18 to a surface. The base plate 18 shown in FIG. 8 includes a slot 50 for receiving an eye bolt 52 extending from the ground, blacktop, or other surface. Stakes or other means for securing the arches may be utilized in place of the base plates 18.

Figure 3A:
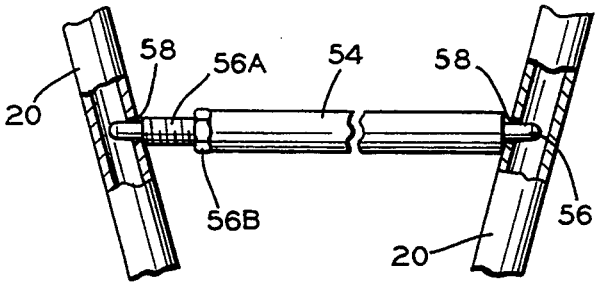
FIG. 3A is a side view of a tension bar with extension shaft mounted between two arches.

The structure 12 also includes the use of tension bars (spreader bars) 54 mounted between adjacent arches 14 for increasing the spacing between the arches to provide the proper tension on the membrane 16. The tension bar 54 is a tubular element provided with a straight shaft 56 on one end and a threaded, extension shaft 56A on the other end for connecting the tension bar 54 to the poles 20. The pole 20 includes a mounting aperture 58 for receipt of the shafts 56 and 56A of the tension bar 54. The sleeve 26 of each fabric segment is provided with openings 60 to permit mounting of the tension bars 54. After both ends of a tension bar 54 have been mounted, the head 56B of the extendable shaft 56A may be rotated to increase the length of the tension bar 54 for securing the arches 14 and maintaining tension on the membrane 16. The extension shaft 56A for the tension bars 54, as shown in FIG. 3A, is similar to the pole extension shaft 30 shown in FIG. 3.

In the present invention, no guide lines or center support structures are needed to maintain the structure 12. The use of the segmented arches 14, tension bars 54, and base plates 18 maintains sufficient tension on the membrane 16 to ensure the integrity of the structure 12. The fabric structure 12 provides efficient space utilization, both internally and externally, when compared with other similar structures.

In erecting the structure 12, the membrane is laid out in the area to be covered by the structure 12. Poles 20 are inserted into the sleeves 26 and connected to the crowns 22 of the arches 14. The base plates are mounted at the corners of the structure 12 at the specific distance for which the structure 12 is designed. The poles 20 of the arches 14 are inserted into the apertures 32 of the base plates 18 by physically compressing the arch 14 into the proper configuration. Once the initial arch 14 is upright, the arch 14 on the opposite side of the structure 12 and then the remaining two arches 14 are moved upright. At that point, the arches 14 stay upright but are not rigidly secured in the base plates 18, and the membrane 16 is not in full tension.

Once all of the arches 14 are upright, the extendable shafts 30 may be extended to move the crowns 22 of the arches 14 to the desired tension in the sleeve 26. The additional width of the sleeve 26 at the crown 22 allows the crown 22 to be raised in order to achieve the curved structure along the gore 38 and the reverse curve seam 46. The sleeve 26 exerts a downward pressure on the arches 14.

The tension bars 54 are then inserted into the apertures 58 in the poles 20. The tension bars 54 are extended by rotating the head 56B of the extension shaft 56A, which secures the arches 14 and maintains tension on the membrane 16.

With the relative configuration of the components thus described, the amount of tension can be adjusted by the extension shafts 30 and 56A on the arches 14 and tension bars 54 so that the membrane will be constantly under tension in all load conditions. As a result, arches 14, which act to take the compression load on the structure 12, are braced against buckling and the entire structure 12 is thus substantially rigid.

Figure 9:
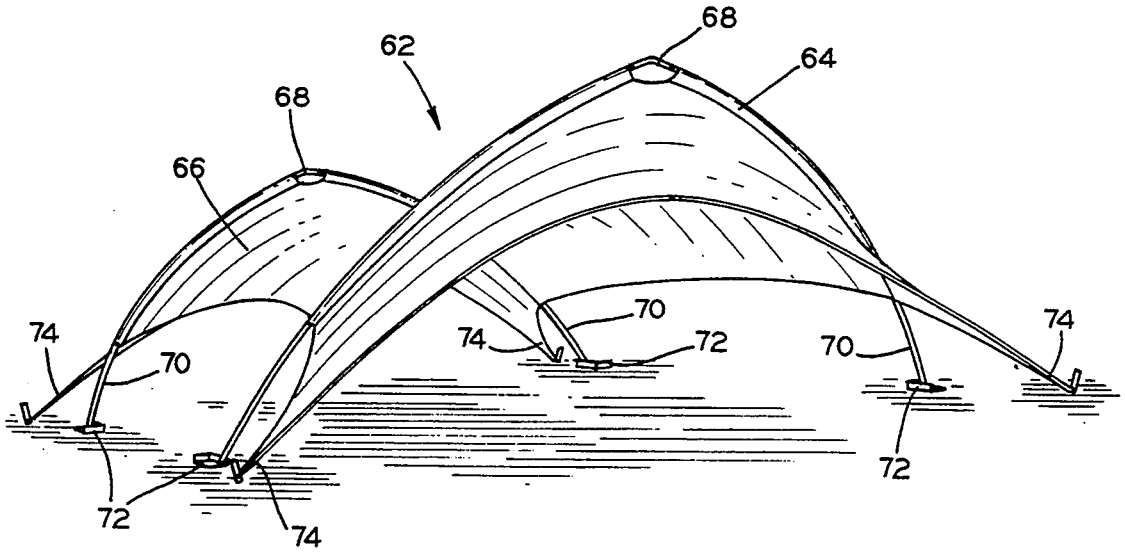
FIG. 9 is a perspective view of a second embodiment of the present invention including two arches for the fabric structure.
Figure 10:
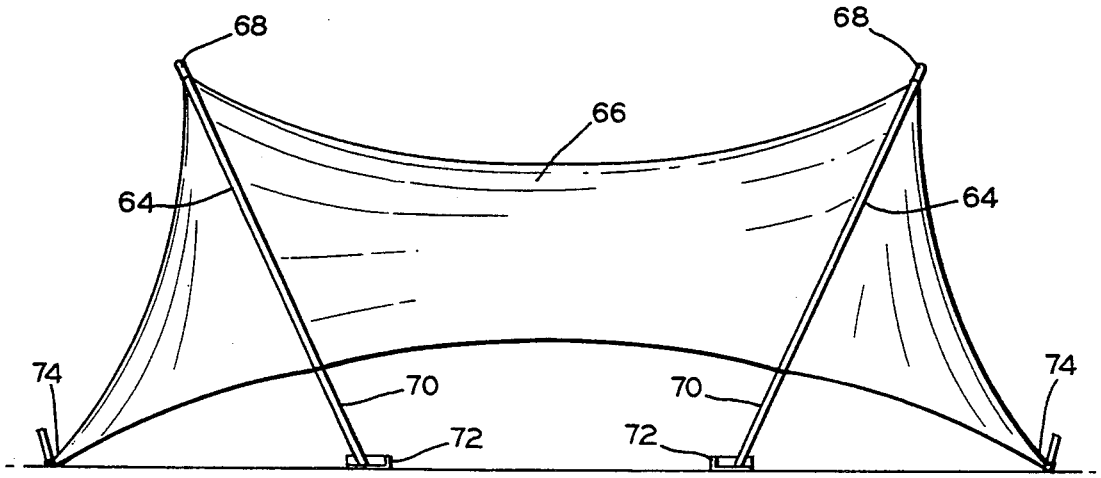
FIG. 10 is a side view of the two arch fabric structure shown in FIG. 9.

In addition to the four arch configuration discussed above, the structure 12 may be built in a similar manner for three or more arches. The two arch embodiment 62 shown in FIGS. 9 and 10 includes sleeve 64 provided with two curved poles 70 and crown 68 to form arches on opposite sides of the structure 62. The sleeves 64 are wider at the apex of the arch and are connected to the membrane 66.

Instead of tension bars, fabric arches are formed in the membrane 66. The extension shaft on poles 70 are mounted in a base plate 72 and the corners 74 of the fabric arches are directly anchored in the ground to provide the necessary tension for the membrane 66.

In accordance with the provisions of the patent statutes, the present invention has been described in what is considered to represent its preferred embodiment. However, it should be noted that the invention can be practiced otherwise than a specifically illustrated and described without departing from its spirit or scope.

What is claimed is:

1. A fabric structure comprising:

a) a plurality of peripheral arched support means positioned to form a periphery of a fabric structure, said arched support means including a first curved pole, a second curved pole, and an angled crown segment;

b) a fabric membrane operatively connected to and extending between said plurality of peripheral arched support means, said fabric membrane including a fabric segment for each arched support means, each fabric segment being provided with a center edge, an outer edge having a first sleeve for receiving the first curved pole and a second sleeve for receiving the second curved pole of said arched support means, and two side edges, said side edges being curved and configured to form a reverse curve when side edges from adjacent fabric segments are sewn back to back to form said fabric membrane; and c) tension means for structurally supporting said arched support means on the periphery of the structure whereby a tensile stress is produced in the fabric segment, a compression load is produced on said arched support means, and said fabric membrane is maintained in tension with said arched support means to form the fabric structure.

2. The fabric structure defined in claim 1 wherein the first curved pole, the second curved pole, and the angled crown segment in said arched support means are disengagably connected, the angled crown segment extending between an open end of the first pole to an open end of the second pole.

3. The fabric structure defined in claim 2 wherein the segmented arch includes means for adjusting the length of the first pole and the second pole.

4. The fabric structure defined in claim 1 including a means for securing the arched support means to a surface.

5. The fabric structure defined in claim 4 wherein said means for securing the arched support means includes a base plate with two mounting apertures for receiving a pole from a first arched support means and a pole from a second arched support means.

6. The fabric structure defined in claim 5 wherein said plurality of arched support means, and an equal number of base plates for securing adjacent arched support means, are arranged to form the periphery of the fabric structure.

7. The fabric structure defined in claim 1 wherein the reverse curves provides increased area inside the structure and a rain channel outside the structure for diverting water from the fabric segments.

8. The fabric structure defined in claim 1 wherein said tension means are mounted between adjacent arched support means.

9. The fabric structure defined in claim 8 wherein said tension means includes tension bars mounted between adjacent arched support means, said tension bars being provided with an extendable shaft for changing the length of the tension bars.

10. The fabric structure defined in claim 9 wherein the fabric segments of said fabric membrane each include a gore extending from the outer edge of the fabric segment adjacent the angled crown segment of the arched support means to the center edge of the fabric segment for expanding the membrane when tension is increased on the membrane by the tension bar.

11. The fabric structure defined in claim 9 wherein the length of the tension bar and the height of the arched support means are adjusted so that the membrane is constantly under tension and the arched support means are compressed to obtain a substantially rigid structure.

12. The fabric structure defined in claim 1 wherein two arched support means are used to form the structure and said tension means includes an arched segment of the fabric membrane anchored in the ground.

13. The fabric structure defined in claim 1 including fabric side panels connected to the fabric membrane at the arched support means.

14. A fabric structure comprising:

a) a plurality of peripheral arches positioned to form a periphery of a fabric structure, said arches including a first curved pole, a second curved pole, an angled crown segment, and means for adjusting the length of the first pole and the second pole;

b) a plurality of base plates, said base plates including two mounting apertures for receiving a pole from a first arch and a pole from a second arch;

c) a fabric membrane operatively connected to and extending between said plurality of peripheral arches, including a fabric segment for each arch, the fabric segments being provided with two partial sleeves along an outer edge of the fabric segments, a first sleeve for receiving the first curved pole and a second sleeve for receiving the second curved pole of an arch; and d) a plurality of tension bars for connecting and structurally supporting said arches on the periphery of the structure, said tension bars including means for adjusting the length of said tension bars, whereby the length of the tension bars and the length of the first pole and second pole are adjusted so that said fabric membrane is constantly under tension and said arches are compressed to obtain a substantially rigid structure.

* * * * *